US012805673B2

(12) United States Patent
Wang et al.

(10) Patent No.: US 12,805,673 B2
(45) Date of Patent: Nov. 24, 2026

(54) ADJUSTABLE HANDRAIL

(71) Applicant: Xinzhiyuan Medical Equipment (Guangdong) Co., Ltd., Foshan (CN)

(72) Inventors: Tianxi Wang, Foshan (CN); Xigen Huang, Foshan (CN); Zhongliang Liu, Foshan (CN); Yudan Huang, Foshan (CN)

( * ) Notice: Subject to any disclaimer, the term of this patent is extended or adjusted under 35 U.S.C. 154(b) by 0 days.

(21) Appl. No.: 19/018,258

(22) Filed: Jan. 13, 2025

(65) Prior Publication Data

US 2026/0182791 A1 Jul. 2, 2026

(30) Foreign Application Priority Data

Dec. 27, 2024 (CN) ..... 202423259034.0

(51) Int. Cl.
*E05B 1/00* (2006.01)
*A47K 17/02* (2006.01)

(52) U.S. Cl.
CPC ..... *A47K 17/024* (2013.01)

(58) Field of Classification Search
CPC ..... B60N 3/026; B60N 3/02; B60N 3/023; B60N 2/24; B60N 2002/247; B60R 13/02; A60G 7/053; A47K 17/022; A47K 17/024; A61G 7/1044; A47B 96/1425; A63B 21/1681; A63B 2244/225; A63B 16/436; A63B 16/438
See application file for complete search history.

(56) References Cited

U.S. PATENT DOCUMENTS 2,419,145 A * 4/1947 Kersenbrock ..... B66C 23/22 212/199
3,568,220 A * 3/1971 Dees ..... A47K 3/003 4/576.1
3,724,791 A * 4/1973 Mason ..... A01K 91/08 248/514
4,932,090 A * 6/1990 Johansson ..... A61G 7/053 5/662
4,976,455 A * 12/1990 Brammer, Sr. ..... B60P 3/36 403/93

(Continued)

FOREIGN PATENT DOCUMENTS

CA 2148521 C * 5/2002 ..... A47K 17/026
CN 206205568 U * 5/2017

(Continued)

*Primary Examiner* — Chuck Y Mah

(57) ABSTRACT

An adjustable handrail, comprising a support rod, a handrail tube, a locking component, and a handrail body, wherein the handrail tube is sleeved on the support rod and can rotate circumferentially relative to the support rod; the locking component comprises a locking plate and a locking latch; the locking plate is connected to the support rod and is provided with a plurality of locking grooves, which are arranged at intervals along the circumference of the locking plate; the locking latch is movably connected to the handrail tube and can be inserted into the locking groove; the handrail body is connected to the handrail tube. Both height adjustment and direction adjustment can be realized, and the user can also adjust the position of the handrail body according to the actual scene requirements, which is more convenient to use and provides a better user experience.

8 Claims, 5 Drawing Sheets

(56) References Cited

U.S. PATENT DOCUMENTS

| | | | | | |
|---|---|---|---|---|---|
| 5,586,352 | A * | 12/1996 | O'Brien | A61G 7/1076 | 248/200.1 |
| 5,887,314 | A * | 3/1999 | Jordan, Jr. | A47L 13/12 | 15/144.3 |
| 8,171,587 | B1 * | 5/2012 | Haessly | A61G 7/1025 | 5/83.1 |
| 9,339,901 | B2 * | 5/2016 | Miller | F16M 11/38 | |
| 2007/0204437 | A1 * | 9/2007 | Hartmann | E04F 11/1804 | 16/444 |
| 2007/0251053 | A1 * | 11/2007 | Miller | A47K 17/024 | 16/110.1 |
| 2008/0098510 | A1 * | 5/2008 | O'Brien | A47K 17/022 | 4/576.1 |
| 2008/0289296 | A1 * | 11/2008 | Weber | A47K 3/003 | 16/421 |
| 2010/0115722 | A1 * | 5/2010 | Malloy | A46B 5/0016 | 15/114 |
| 2011/0084578 | A1 * | 4/2011 | Newkirk | A61G 7/1038 | 211/96 |
| 2016/0184164 | A1 * | 6/2016 | Browning | A63B 21/015 | 482/115 |
| 2020/0345187 | A1 * | 11/2020 | Edwards | A47K 17/024 | |
| 2022/0160123 | A1 * | 5/2022 | Scanlon | A47K 3/281 | |
| 2024/0315501 | A1 * | 9/2024 | Alder | A47K 17/022 | |

FOREIGN PATENT DOCUMENTS

| | | | | |
|---|---|---|---|---|
| EP | 727530 | A1 * | 8/1996 | |
| FR | 2563893 | A * | 11/1985 | |
| JP | 2005282014 | A * | 10/2005 | A47K 17/024 |

* cited by examiner

ADJUSTABLE HANDRAIL

TECHNICAL FIELD

The invention related to the technical field of handrails, and in particular to an adjustable handrail.

BACKGROUND ART

Handrails are commonly used assistive tools in life, which are usually installed in toilets, bathrooms, sofas, beds and other places where people need to get up. They can maintain body balance or support the body, help the elderly get up or prevent the elderly and children from falling and slipping on slippery floors. After the existing handrails are installed, it is difficult to adjust the position of the handrails, the adaptability is poor, and it is not convenient to use.

SUMMARY OF THE INVENTION

The purpose of the invention is to provide an adjustable handrail, aiming to solve the problem that the position of the existing handrails cannot be adjusted, resulting in inconvenience in use.

In order to achieve the above purpose, the invention adopts the following technical solutions:

an adjustable handrail, comprising:

a support rod;

a handrail tube, which is sleeved on the support rod and can rotate circumferentially relative to the support rod;

a locking component, which comprises a locking plate and a locking latch; the locking plate is connected to the support rod and is provided with a plurality of locking grooves, which are arranged at intervals along the circumference of the locking plate; the locking latch is movably connected to the handrail tube and can be inserted into the locking groove;

a handrail body, which is connected to the handrail tube.

Optionally, the locking component further comprises a locking handle connected to the locking latch.

Optionally, the locking component further comprises a locking seat, which is provided with an avoidance hole; the locking handle passes through the avoidance hole and is connected to the locking latch.

Optionally, one side of the locking seat close to the handrail tube is provided with a guide hole extending in a vertical direction, and the locking latch passes through the guide hole and is inserted into the locking groove.

Optionally, the locking handle comprises a connecting part; the avoidance hole is a waist-shaped hole adapted to the connecting part, and the connecting part can move in the avoidance hole in a vertical direction; the locking latch is connected to the connecting part via a screw.

Optionally, the locking component further comprises an elastic piece; an inside of the locking seat is provided with an accommodating groove that is communicated with the guide hole, and the elastic piece is arranged in the accommodating groove; the diameter of a lower end of the locking latch is greater than the diameter of an upper end thereof, a lower end of the elastic piece abuts against the lower end of the locking latch, and an upper end of the elastic piece abuts against an inside of the accommodating groove.

Optionally, it further comprises a limit gasket and a limit adjustment nut; the support rod comprises a first support tube, a second support tube, and a threaded adjustment tube, and the threaded adjustment tube comprises a threaded part and a sleeve part; the threaded part is plugged into the first support tube, the second support tube is plugged into the sleeve part, and the handrail tube is sleeved into the first support tube; the limit adjustment nut is threaded to the threaded part and is located on an upper side of the handrail tube, and the limit gasket is connected to the first support tube and is located on upper and lower sides of the handrail tube.

Optionally, it further comprises a fixing latch, and the sleeve part is provided with an adjustment fixing hole; the second support tube is provided with a plurality of position adjustment holes, which are arranged at intervals along an axial direction of the second support tube.

Optionally, it further comprises four semicircular hollow sleeves made of plastic, two of which are sleeved on the support rod and abut against the limit gasket, and the other two are sleeved on the support rod and abut against the limit adjustment nut; the handrail tube is sleeved on the four semicircular hollow sleeves.

Optionally, it further comprises a bottom plate connected to a bottom of the support rod and a top cover connected to a top of the support rod.

Compared with the prior art, the beneficial effects of the invention are:

In the adjustable handrail provided by the invention, both height adjustment and direction adjustment can be realized. The entire support rod has the function of telescopic adjustment. The first support tube and the second support tube mainly realize the coarse adjustment of the height, and the threaded adjustment tube realizes the fine adjustment of the height, thereby realizing height adjustment. In addition, the handrail tube can rotate relative to the support rod. Even after the entire adjustable handrail is installed, the position of the handrail body can still be adjusted by rotating the handrail tube. After the adjustment is completed, the locking latch movably connected to the handrail tube is inserted into the locking groove of the locking plate. At this time, the handrail tube cannot continue to rotate, thereby completing the fixing of the handrail tube, and the adjustment is more convenient and quick. The user can also adjust the position of the handrail body according to actual needs, which is more convenient to use and has a better user experience.

BRIEF DESCRIPTION OF THE DRAWINGS

In order to illustrate the technical solution of the invention or the prior art more clearly, the drawings used in the embodiments or the description of the prior art will be briefly introduced hereinafter. It is obvious that the drawings hereinafter are just some of the embodiments of the invention. Those of ordinary skill in the art can obtain other drawings according to these drawings without creative efforts.

Figure 1:
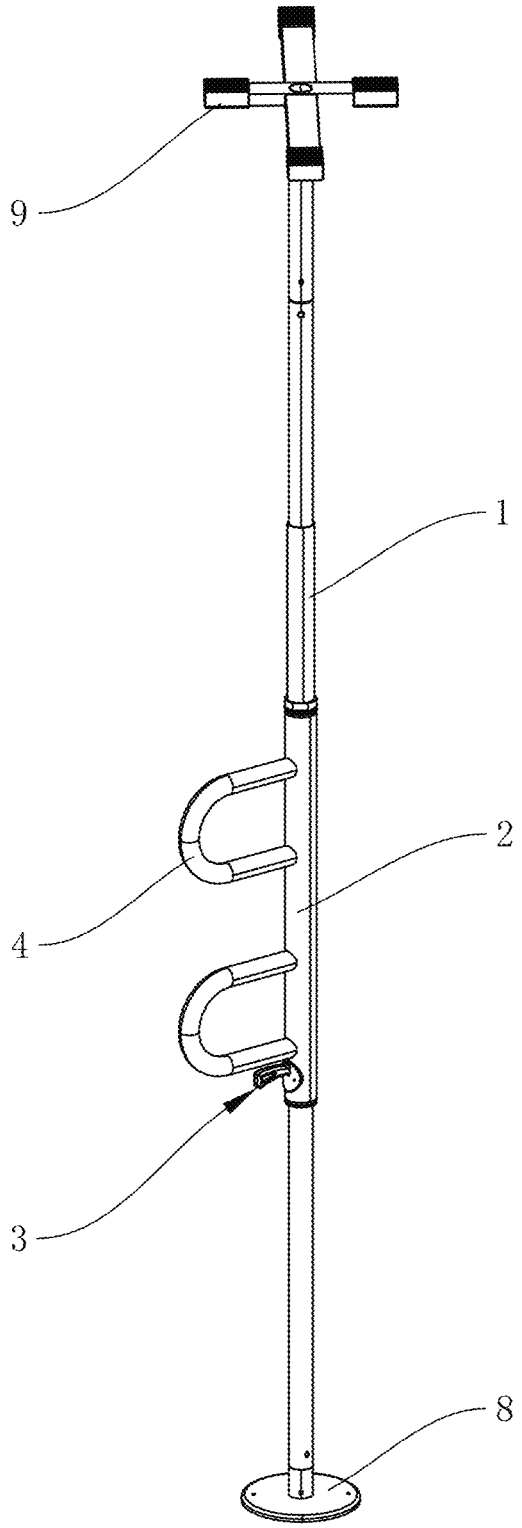
FIG. 1 is a schematic structural diagram of the adjustable handrail according to the invention.

In the figures: 1 refers to the support rod; 11 refers to the first support rod; 12 refers to the second support rod; 13 refers to the threaded adjustment rod; 131 refers to the threaded part; 132 refers to the sleeve part; 14 refers to the adjustment fixing hole; 15 refers to the position adjustment hole; 2 refers to the handrail tube; 3 refers to the locking component; 31 refers to the locking plate; 32 refers to the locking latch; 33 refers to the locking groove; 34 refers to the locking handle; 35 refers to the locking seat; 36 refers to the avoidance hole; 37 refers to the guide hole; 38 refers to the connecting part; 39 refers to the screw; 310 refers to the elastic piece; 4 refers to the handrail body; 5 refers to the limit gasket; 6 refers to the limit adjustment nut; 7 refers to the hollow sleeve; 8 refers to the bottom plate; 9 refers to the top cover; 10 refers to the fixing latch.

SPECIFIC EMBODIMENT OF THE INVENTION

The technical solutions in the embodiments of the invention will be clearly and completely described hereinafter with reference to the drawings in the embodiments of the invention. Obviously, the described embodiments are only a part of the embodiments of the invention, rather than all the embodiments. Based on the embodiments of the invention, all other embodiments obtained by those of ordinary skill in the art without creative efforts shall fall within the protection scope of the invention.

In the description of the invention, it should be understood that the orientation or positional relationship indicated by the terms "center", "longitudinal", "transverse", "length", "width", "thickness", "upper", "lower", "front", "back", "left", "right", "vertical", "horizontal", "top", "bottom", "inner", "outer", "clockwise", "counterclockwise" etc. are based on the orientation or positional relationship shown in the drawings, and is only for the convenience of describing the invention and simplifying the description, but not indicate or imply that the pointed device or element must have a specific orientation, be constructed and operated in a specific orientation, and therefore cannot be understood as a limitation of the invention.

In addition, the terms "first" and "second" are only used for descriptive purposes, and cannot be understood as indicating or implying relative importance or implicitly indicating the number of indicated technical features. Thus, the features defined with "first" and "second" may explicitly or implicitly include one or more of these features.

Figure 2:
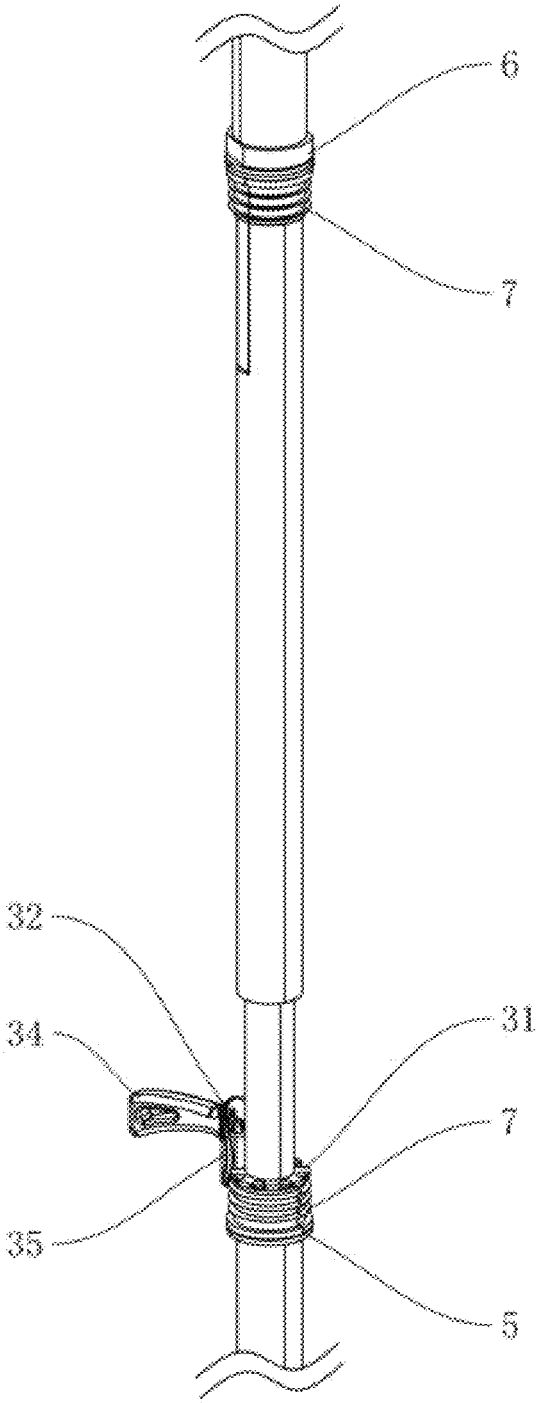
FIG. 2 is a schematic diagram of the installation structure of the locking component in the adjustable handrail according to the invention.
Figure 3:
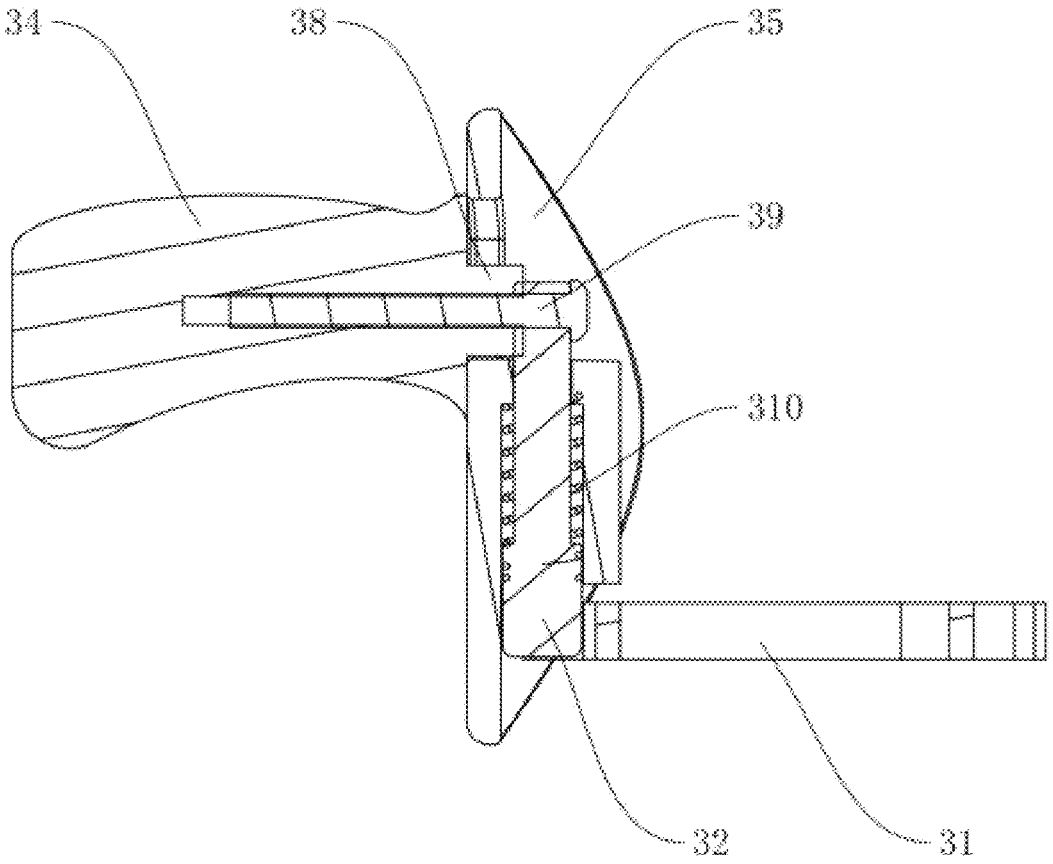
FIG. 3 is a schematic diagram of the internal structure of the locking component in the adjustable handrail according to the invention.
Figure 4:
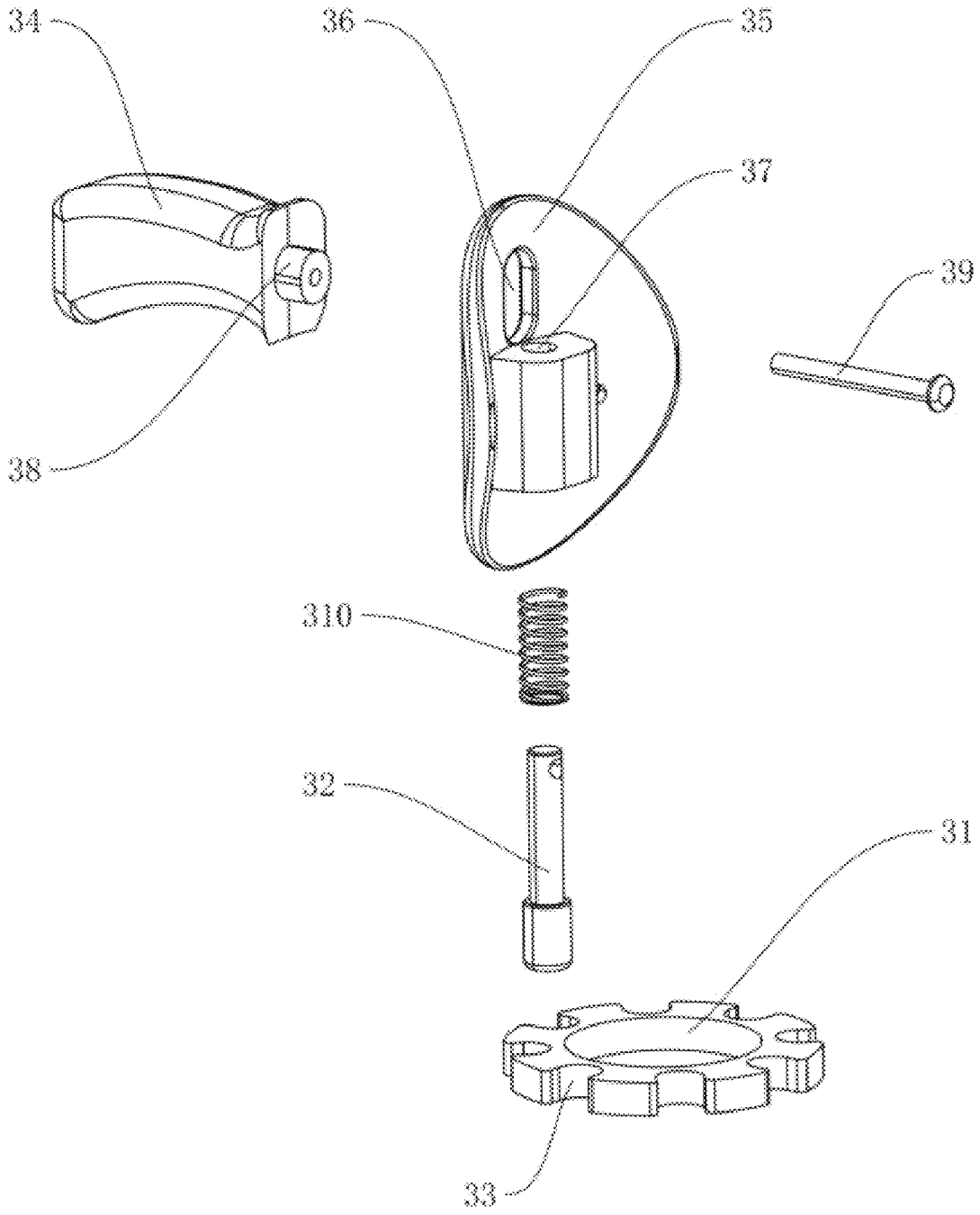
FIG. 4 is an exploded schematic diagram of the locking component in the adjustable handrail according to the invention.
Figure 5:
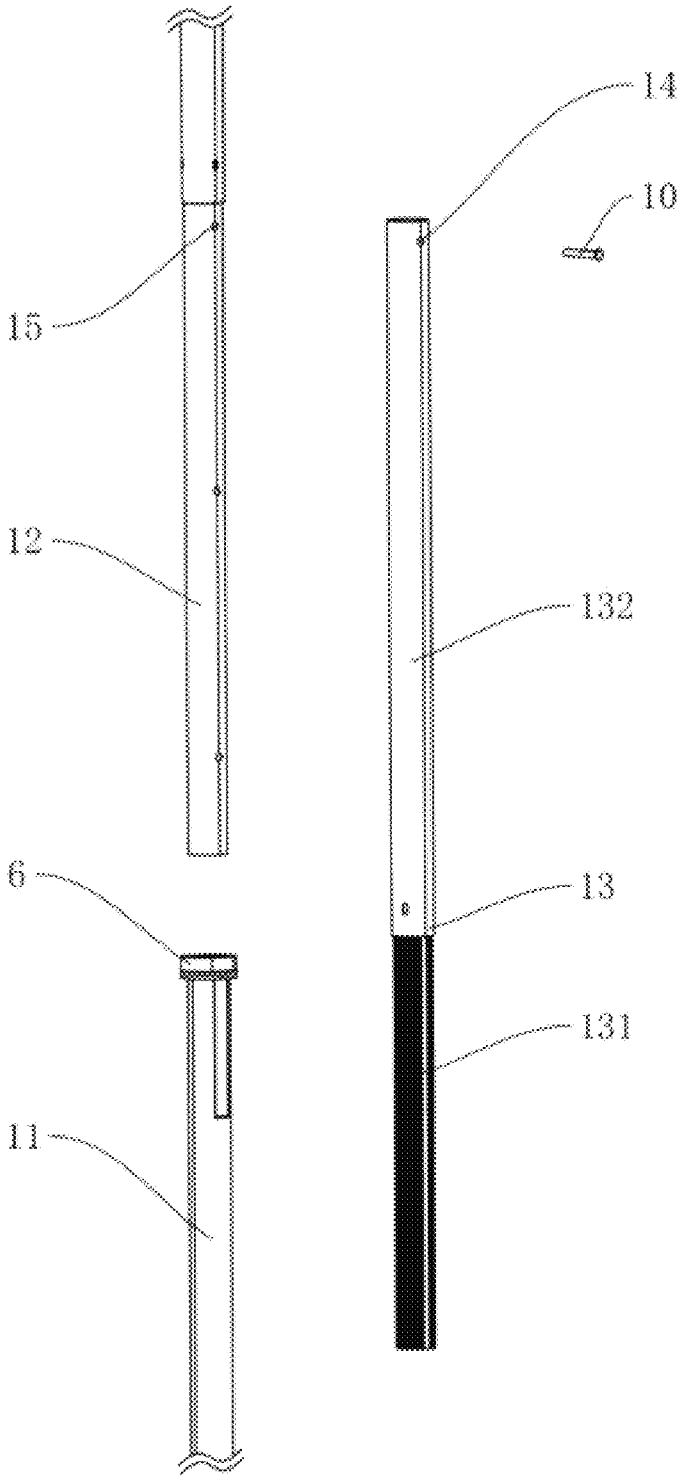
FIG. 5 is an exploded schematic diagram of the support rod in the adjustable handrail according to the invention.

The adjustable handrail of the invention will be described hereinafter with reference to FIGS. 1-5.

As shown in FIGS. 1-5, the invention provides an adjustable handrail, which is mainly used in bathrooms, and can also be used in places such as sofas and beds. The adjustable handrail of the invention comprises a support rod 1, a handrail tube 2, a locking component 3, and a handrail body 4, wherein the handrail tube 2 is sleeved on the support rod 1 and can rotate circumferentially relative to the support rod 1; the locking component 3 comprises a locking plate 31 and a locking latch 32; the locking plate 31 is connected to the support rod 1 and is provided with a plurality of locking grooves 33, which are arranged at intervals along the circumference of the locking plate 31; the locking latch 32 is movably connected to the handrail tube 2 and can be inserted into the locking groove 33; the handrail body 4 is connected to the handrail tube 2.

In the adjustable handrail provided by the invention, both height adjustment and direction adjustment can be realized. The handrail tube 2 can rotate relative to the support rod 1. Even after the entire adjustable handrail is installed, the position of the handrail body 4 can still be adjusted by rotating the handrail tube 2. After the adjustment is completed, the locking latch 32 movably connected to the handrail tube 2 is inserted into the locking groove 33 of the locking plate 31; at this time, the handrail tube 2 cannot continue to rotate, thereby completing the fixation of the handrail tube 2, and the adjustment is more convenient and quick. The user can also adjust the position of the handrail body 4 according to actual needs, which makes it more convenient to use and provides a better user experience.

In some embodiments, the locking component 3 further comprises a locking handle 34 connected to the locking latch 32. By moving the locking handle 34 up and down, the user can more conveniently adjust the position of the locking latch 32 and can more conveniently drive the locking latch 32 to be inserted into the locking groove 33 or leave the locking groove 33, which is more convenient to operate.

In some embodiments, the locking component 3 further comprises a locking seat 35, which is provided with an avoidance hole 36; the locking handle 34 passes through the avoidance hole 36 and is connected to the locking latch 32. The locking seat 35 can provide a location for installing the locking handle 34 and the locking latch 32, and the overall structure is more reasonable.

In some embodiments, one side of the locking seat 35 close to the handrail tube 2 is provided with a guide hole 37 extending in a vertical direction, and the locking latch 32 passes through the guide hole 37 and is inserted into the locking groove 33. The locking latch 32 can be more accurately inserted into the locking groove 33 via the guide hole 37.

In some embodiments, the locking handle 34 comprises a connecting part 38; the avoidance hole 36 is a waist-shaped hole adapted to the connecting part 38, and the connecting part 38 can move in the avoidance hole 36 in a vertical direction. The avoidance hole 36 can provide an operating space for the locking handle 34, and the overall structure is more reasonable. The locking latch 32 is connected to the connecting portion 38 by a screw 39, which is convenient for installation and disassembly.

In some embodiments, the locking component 3 further comprises an elastic piece 310; an inside of the locking seat 35 is provided with an accommodating groove that is communicated with the guide hole 37, and the elastic piece 310 is arranged in the accommodating groove; the diameter of a lower end of the locking latch 32 is greater than the diameter of an upper end thereof, a lower end of the elastic piece 310 abuts against the lower end of the locking latch 32, and an upper end of the elastic piece 310 abuts against an inside of the accommodating groove. The elastic piece 310 can drive the locking latch 32 to always maintain a downward movement trend. In the absence of external force, the locking latch 32 can be stably inserted into the locking groove 33, and the handrail body 4 will not move, with good stability and safer use.

In some embodiments, it further comprises a limit gasket 5 and a limit adjustment nut 6; the support rod 1 comprises a first support tube 11, a second support tube 12, and a threaded adjustment tube 13, and the threaded adjustment tube 13 comprises a threaded part 131 and a sleeve part 132; the threaded part 131 is plugged into the first support tube 11, the second support tube 12 is plugged into the sleeve part 132, and the handrail tube 2 is sleeved into the first support tube 11; the limit adjustment nut 6 is threaded to the threaded part 131 and is located on an upper side of the handrail tube 2, and the limit gasket 5 is connected to the first support tube 11 and is located on a lower end of the handrail tube 2. Relatively speaking, the first support tube 11 and the second support tube 12 are mainly used to achieve coarse adjustment of the height. After the rough installation is completed, the height is finely adjusted by rotating the threaded adjustment tube 13, and then the limit adjustment nut 6 is tightened to fix the height of the entire support rod 1 to complete the installation. Through such a design, it can be installed at different heights, and the adjustment is also more convenient.

In some embodiments, it further comprises a fixing latch 10, and the sleeve part 132 is provided with an adjustment fixing hole 14; the second support tube 12 is provided with a plurality of position adjustment holes 15, which are arranged at intervals along an axial direction of the second support tube 12. The fixing latch 10 is inserted into the adjustment fixing hole 14 and the position adjustment hole 15, and the second support tube 12 can achieve coarse adjustment of the height. Adjustment of different heights can be achieved by the plurality of position adjustment holes 15, and the adjustment is more convenient.

In some embodiments, there are two handrail bodies 4, which are spaced apart in the vertical direction, and can meet the needs of users of different heights, with better adaptability.

In some embodiments, the number of the handrail bodies 4 can be adjusted according to actual scene requirements.

In some embodiments, the handrail body 4 is spirally distributed on the handrail tube 2

In some embodiments, it further comprises four semicircular hollow sleeves 7 made of plastic, two of which are sleeved on the support rod 1 and abut against the limit gasket 5, and the other two are sleeved on the support rod 1 and abut against the limit adjustment nut 6; the handrail tube 2 is sleeved on the four semicircular hollow sleeves 7. The handrail tube 2 can be stably installed on the support rod 1 via the semicircular hollow sleeves 7.

In some embodiments, it further comprises a bottom plate 8 connected to a bottom of the support rod 1 and a top cover 9 connected to a top of the support rod 1, so that the entire adjustable handrail can be better installed in the bathroom.

The above are only the preferred specific embodiments of the invention, but the protection scope of the invention is not limited thereto. Equivalent replacements or modifications according to the technical solution and inventive concept of the invention made by any person familiar with the technical field within the technical scope disclosed in the invention shall all fall within the protection scope of the invention.

The invention claimed is:

1. An adjustable handrail, comprising:

a support rod;

a handrail tube, which is sleeved on the support rod and rotatable circumferentially relative to the support rod;

a locking component, which comprises a locking plate and a locking latch; the locking plate is connected to the support rod and is provided with a plurality of locking grooves, the locking grooves are arranged at intervals along the circumference of the locking plate; the locking latch is movably connected to the handrail tube and is selectively inserted into any one of the locking grooves;

a handrail body, which is connected to the handrail tube;

the locking component further comprises a locking handle connected to the locking latch; wherein, the locking component further comprises a locking seat, which is provided with an avoidance hole: the locking handle passes through the avoidance hole and is connected to the locking latch.

2. The adjustable handrail of claim 1, wherein one side of the locking seat close to the handrail tube is provided with a guide hole extending in a vertical direction, and the locking latch passes through the guide hole and is inserted into one of the locking grooves.

3. The adjustable handrail of claim 2, wherein the locking handle comprises a connecting part; the avoidance hole is a waist-shaped hole adapted to the connecting part, and the connecting part can move in the avoidance hole in a vertical direction; the locking latch is connected to the connecting part via a screw.

4. The adjustable handrail of claim 3, wherein the locking component further comprises an elastic piece; an inside of the locking seat is provided with an accommodating groove that is communicated with the guide hole, and the elastic piece is arranged in the accommodating groove; the diameter of a lower end portion of the locking latch is greater than the diameter of an upper end portion thereof; a lower end of the elastic piece abuts against an upper end of the lower end portion of the locking latch, and an upper end of the elastic piece abuts against an inside end of the accommodating groove.

5. The adjustable handrail of claim 1, wherein it further comprises a limit gasket and a limit adjustment nut; the support rod comprises a first support tube, a second support tube, and a threaded adjustment tube, and the threaded adjustment tube comprises a threaded part and a sleeve part; the threaded part is plugged into the first support tube, the second support tube is plugged into the sleeve part, and the handrail tube is sleeved into the first support tube; the limit adjustment nut is threaded to the threaded part and is located on an upper side of the handrail tube, and the limit gasket is connected to the first support tube and is located on a lower end of the handrail tube.

6. The adjustable handrail of claim 5, wherein it further comprises a fixing latch, and the sleeve part is provided with an adjustment fixing hole; the second support tube is provided with a plurality of position adjustment holes, which are arranged at intervals along an axial direction of the second support tube.

7. The adjustable handrail of claim 6, wherein it further comprises four semicircular hollow sleeves made of plastic, two of which are sleeved on the support rod and abut against the limit gasket, and the other two are sleeved on the support rod and abut against the limit adjustment nut; the handrail tube is sleeved on the four semicircular hollow sleeves.

8. The adjustable handrail of claim 1, wherein it further comprises a bottom plate connected to a bottom of the support rod and a top cover connected to a top of the support rod.

* * * * *